US005894804A

United States Patent [19]

Werner

[11] Patent Number: 5,894,804

[45] Date of Patent: Apr. 20, 1999

[54] PALLET SEPARATOR SHEET FOR PROTECTING PALLETIZED CARGO AND METHOD THEREFOR

[76] Inventor: Gary D. Werner, 70 S. Eaton Ct., Lakewood, Colo. 80226

[21] Appl. No.: 08/596,596

[22] Filed: Feb. 5, 1996

[51] Int. Cl.[6] ..... B65D 19/38

[52] U.S. Cl. ..... 108/53.5; 312/57.12; 312/57.34

[58] Field of Search ..... 108/51.1, 57.34, 108/53.1, 53.5, 53.7, 57.12

[56] References Cited

U.S. PATENT DOCUMENTS

| | | | |
|---|---|---|---|
| 3,433,184 | 3/1969 | Addy | 108/53.3 |
| 4,042,127 | 8/1977 | Brossia | 108/51.3 |
| 5,570,643 | 11/1996 | Werner | 108/51.1 |

*Primary Examiner*—Peter M. Cuomo
*Assistant Examiner*—Gerald A. Anderson
*Attorney, Agent, or Firm*—Timothy J. Martin; Michael R. Henson

[57] ABSTRACT

A pallet separator sheet is disclosure for placement between tiers of palletized cargo. The sheet inhibits movement of the cargo of a upper tier. The sheet protects the cargo of a lower tier and has a surface which grips the cargo of the lower tier. The separator sheet can include a first upper sheet of a stiff yet pliable first material having protrusions extending upwardly. A second lower sheet, preferable having cavities, is joined to a lower surface of the upper sheet so that the sheets are congruent. The second lower sheet having a greater coefficient of friction than the upper sheet. Separator sheet is generally rectangular and can have a lip extending at an angle to the main body of the separator sheet.

19 Claims, 2 Drawing Sheets

PALLET SEPARATOR SHEET FOR PROTECTING PALLETIZED CARGO AND METHOD THEREFOR

FIELD OF THE INVENTION

The present invention relates to pallet separator sheets which are adapted to be placed between multiple tears of palletized cargo. More particularly, the present invention is directed to pallet separator sheets that allow for storage and transportation of palletized cargo with a reduced risk of damage to the cargo from load shifting and slippage.

BACKGROUND OF THE INVENTION

With the increasing demands of today's economy, it is necessary for manufacturers to deliver their products to consumers in an efficient manner. To meet these demands, manufacturers often ship large quantities of packaged products to wholesalers and distributors which, in turn, transport smaller quantities of these packaged products to local retailers and dealers In the initial stages of the shipping system, packaged products are often stored in a manufacturer's warehouse and thereafter loaded onto trailer trucks for transportation to a desired location.

For years, conventional pallets have been the work horses of the shipping industry. These pallets, which are essentially platforms upon which goods are placed for storage and transportation, are fabricated from a variety of materials and, for decades, have been particularly effective in moving large quantities of products from one location to another. Wood is probably the most common material used to construct shipping pallets. Of course, other types of pallet materials have also been employed by those in the transportation industry as substitutes for the conventional wooden pallets. The evolution of these other types of pallets has been due, at least in part, to the limited useful life of wooden pallets as well as the increasing costs of wood in recent years. Alternative, less costly materials which have been used for fabricating pallets include plastics as well as metal.

Pull sheet pallets, for example, have been developed as a replacement to conventional wooden pallets for the purpose of transporting cargo from one location to another. In general, a pull sheet pallet is a sheet of material, such as polypropylene or high density polyethylene, which has a high tensile strength. A pull sheet pallet is placed upon a floor of a warehouse or truck so that cargo can be loaded onto it. The pull sheet pallet may incorporate a lip which projects upwardly and outwardly in order that a gripper bar of a motorized vehicle can grasp the lip and pull the pull sheet pallet onto a platen of the vehicle. Some in the transportation industry consider the pull sheet pallet to be an effective substitute for conventional pallets for various reasons. First, pull sheet pallets are relatively inexpensive. Second, these pull sheet pallets are not nearly as bulky as conventional pallets because they may only be millimeters thick. Thus, pull sheet pallets are light weight and compact for storage. Third, although pull sheet pallets occasionally tear, they are far more durable than conventional pallets.

One type of pull sheet pallet is disclosed in U.S. Pat. No. 5,226,372 to Frenkel. This pull sheet pallet, fabricated of a plastic material such as polypropylene and high density polyethylene, has a plurality of nubs projecting from a lower surface thereof and a plurality of corresponding recesses formed into an upper surface thereof. The plastic material is stiff yet resilient so that when cargo is placed on the upper surface of the pallet and thereafter transported, shock may be absorbed by minute contractions and subsequent expansions of the nibs. Frenkel's pull sheet pallet also incorporates a lip which may be grasped by the gripper bar of the motorized lift vehicle so that the loaded pull sheet pallet can be pulled onto a platform.

In an effort to optimize storage capacity in warehouses, manufacturers often stack multiple tiers of palletized cargo on top of another. Each of these tiers of palletized cargo consists, essentially, of a base pallet, of either the wood, plastic or metal type, upon which the packaged products are supported for storage. Typically these packaged products are in the form of individually boxed products, several products packaged in a large container, or bags. With these stacked arrangements, the cargo associated with a lower tier of the palletized products is required to directly support an upper tier of palletized cargo. Thus, the lower cargo is placed in direct contact with the pallet associated with the upper tier. Depending upon the condition of the upper pallet and the weight of its load, the cargo associated with the lower pallet can become permanently damaged. Moreover, even when the stacked or tiered pallets are stationary relative to the other, damage can be exacerbated when the pallets are transported by a conventional forklift. Damage can also arise when the stacked cargo is transported in moving rail cars. Not only can the mere shifting of the upper palletized cargo cause excessive wear on the cargo located therebelow, but splintering of the upper pallet can puncture the lower cargo.

In an effort to alleviate the potential damage resulting from conventional shipping techniques, the transportation industry has been known to employ pallet separator sheets which are interposed between the multiple tiers of palletized cargo. Such a separator sheet typically has a lower surface which spans across and is in contact with the lower cargo and an opposite upper surface which is in direct contact with the pallet associated with the upper tier of palletized cargo. These pallet separator sheets are typically constructed of fiber, corrugate or plywood However, while these sheets may be suitable to add protection from dust, moisture and spillage, they are not well suited to provide a durable covering which is adapted to protect against the potential problems discussed above.

Accordingly, there is a need in the transportation industry to provide a new and useful pallet separator sheet which is adapted to be placed between tiers of palletized cargo to allow for storage and transportation of the tiers with a reduced risk of damage to the cargo. The present invention accomplishes this objective, among others by modifying the construction of known slip sheet pallets to provide a device which is uniquely suitable for use as a pallet sheet separator.

SUMMARY OF INVENTION

It is an object of the present invention to provide a new and useful pallet separator sheet which is adapted to be interposed between multiple tiers of palletized cargo.

Another object of the present invention is to provide a pallet separator sheet which is particularly suited to avoid unnecessary damage to cargo during storage and transportation thereof.

It is a further object of the present invention to provide a pallet separator sheet which is relatively inexpensive to manufacture so that it may be re-used, recycled or discarded at the discretion of a user.

Yet another object of the present invention is to provide a pallet separator sheet which is adapted to grip the cargo associated with a lower one of the tiers of palletized cargo.

Still a further object of the present invention is to provide a pallet separator sheet which is suitably constructed to inhibit relative movement of an upper palletized cargo load while providing a protective layer for cargo located therebelow.

Yet another object of the present invention is to provide a new and useful methodology for protecting stacked palletized cargo against lateral slippage during transportation.

According to the present invention, as hereinafter described, the pallet separator sheet is adapted to be placed between multiple tiers of palletized cargo, which each includes a pallet upon which cargo is supported, to allow for storage and transportation of the tiers with a reduced risk of damage to the cargo. In one of its forms, the pallet separator sheet of the present invention comprises a first sheet constructed of a stiff yet pliable first material, such as a high density polyethylene, which has an upper first sheet surface that is adapted to be placed in contact with the pallet associated with an upper one of the tiers of palletized cargo and an opposite lower first sheet surface which is in a facing relationship with a cargo associated with the lower one of the tiers of palletized cargo. A plurality of nub structures are disposed on this first sheet so that a plurality of protrusions extend upwardly from the upper first sheet surface. A layer of second material is disposed on the lower first sheet surface. This second material, which may be a low density polyethylene, has a greater coefficient friction than the first material to allow the lower first sheet surface to grip the cargo associated with the lower tier.

It is preferred that the layer of second material is constructed as a second sheet which is geometrically congruent with the first sheet and laminated to the first sheet to form a composite sheet. This composite sheet, thus, has a lower composite sheet surface which is defined by a lower surface of the second sheet and an upper composite sheet surface which is defined by the upper first sheet surface. The composite sheet has a surrounding peripheral edge and a thickness between the upper and lower composite sheet surfaces, and this thickness may be between 0.015 inches and 0.08 inches, inclusively It is preferred that a plurality of concavities are formed into the lower first sheet surface to correspond with the plurality of protrusions so that when the first sheet is placed between the tier of palletized cargo, contacted ones of the nub structures operate to collapse, while uncontacted ones of the nub structures form a raised barrier on the upper first sheet surface which resists sliding movement of the pallet thereacross. These nub structures may take on a variety of configurations to accomplish this.

A lip may be included which extends downwardly and outwardly from a portion of a periphery of the first sheet of material or from a portion of the peripheral edge of the composite sheet. Where the first and second sheets are rectangularly configurated, the peripheral edge of the composite sheet has a pair of opposed longitudinal side edges and a pair of opposed lateral side edges, with the lip extending from the opposed lateral side edges of the composite sheet.

In an alternative form of the present invention, the pallet separator sheet comprises the first sheet of first material, the layer of second material and the lip. With this construction, then, it should be appreciated that the pallet separator sheet need not include a plurality of nub structures formed into the first sheet. The lip, again, is connected to a portion of the outer periphery of the first sheet and extends downwardly and outwardly at an obtuse angle relative to the first sheet of material. Preferably, this angle of inclination is between 105° and 135°, inclusively. With this construction, the characteristics of the first sheet, the lip and the layer of second material are preferably the same as those discussed above. It should be appreciated, though, that a plurality of nub structures may also be incorporated into this construction if desired so that the upper first sheet surface is adapted to resist sliding movement of the pallet thereacross.

According to the methodology of the present invention, a method is provided for protecting stacked palletized cargo against lateral slippage during shipment. Initially, a first unit of cargo is placed at a selected location. This first unit of cargo preferably includes a pallet and a selected cargo supported by the pallet. Next, the selected cargo is covered by a separator sheet that has a lower surface and an opposite upper surface. The separator sheet is formed by at least two materials having different coefficients of friction, with the lower surface of the separator sheet having a higher coefficient of friction than the upper surface. Then, a second unit of cargo is placed on top of the first unit of cargo. This second unit has a second pallet contacting the upper surface of the separator sheet whereby the second unit is supported by the cargo associated with the first unit. Thus, the separator sheet is interposed between the first and second units of cargo. This separator sheet is constructed with the features described above.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

A pallet separator sheet of the present invention is adapted to be placed between multiple tiers of palletized cargo that each includes a pallet upon which cargo is supported. The pallet separator sheet allows for storage and transportation of the tiers with a reduced risk of damage to the cargo. From the discussion to follow it should be understood by one of ordinary skill that the pallet separator sheet of the present invention is a suitable replacement for the fiber board, corrugate and plywood sheets that are commonly employed in the shipping industry for use with stacked tears of palletized cargo.

Figure 1:
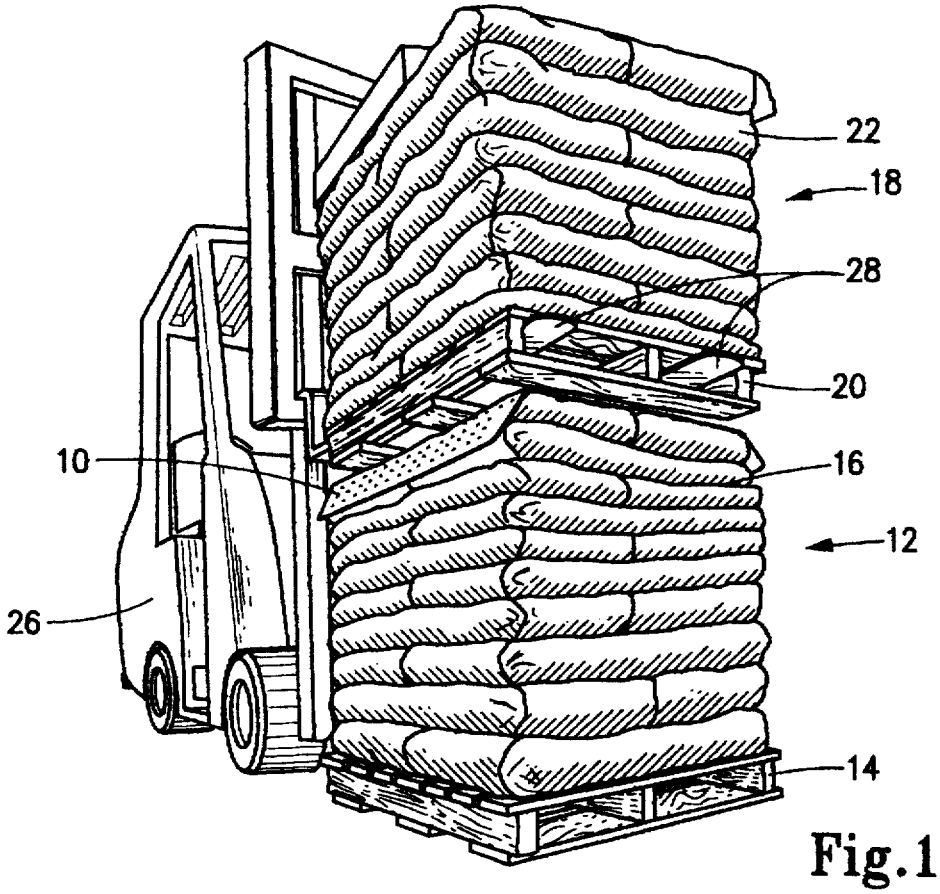
FIG. 1 is a perspective view of a pallet separator sheet according to the present invention shown interposed between two tiers of palletized cargo and showing a conventional forklift in the process of lifting one of the tiers of palletized cargo so that it may be transported.
Figure 2:
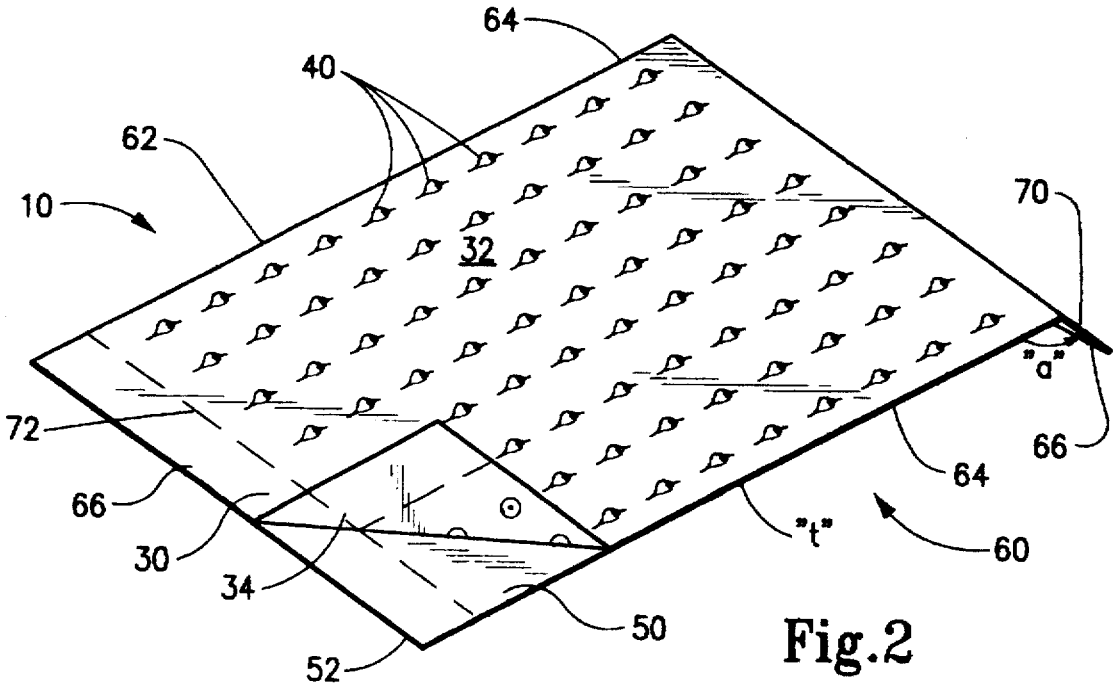
FIG. 2 is a perspective view of the pallet separator sheet according to the present invention and with the upper layer thereof partially peeled away to expose the lower layer of the sheet.

A pallet separator sheet 10 of the present invention is generally introduced in FIGS. 1 and 2. Pallet separator sheet 10 is adapted to be interposed between multiple tiers of palletized cargo. As shown in FIG. 1, a lower tier of palletized cargo 12 includes a lower pallet 14 upon which cargo 16 is supported. Likewise, an upper tier of palletized cargo 18 includes an upper pallet 20 upon which cargo 22 is supported. Either or both of the tiers of palletized cargo 12 and 18 may be moved by a motorized vehicle shown here as a conventional forklift 26, which has spaced apart forks 28 for lifting the palletized cargo. Forklift 26 is shown in FIG. 1 removing the upper tier of palletized cargo 18 so that it may be transported to a desired location.

As best shown in FIG. 2, pallet separator sheet 10 comprises a first sheet 30 that is constructed of a stiff yet pliable material, a plurality of nub structures 40, and a layer of second material 50. First sheet 30 has an upper first sheet surface for first sheet surface 32 and an opposite lower first sheet surface for second sheet surface 34. Referring back to FIG. 1, upper first sheet surface 32 is adapted to be placed in contact with the pallet 20 associated with upper tier 18, while the lower first sheet surface 34 is disposed in a facing relationship and in contact with the selected cargo 16 associated with the lower tier of palletized cargo 12. First sheet 30 is preferably formed of a high density polyethylene material.

The layer of second material 50 is preferably constructed as a second sheet which is laminated to the first sheet 30 thereby to form a composite sheet 60 which has a lower composite sheet surface, that is defined by a lower surface 52 of second sheet 50, and an upper composite sheet surface, which is defined by surface 32. Composite sheet 60 has a surrounding peripheral edge 62 and a thickness "t" between the upper and lower composite sheet surfaces. This thickness is preferably between 0.015 inches and 0.08 inches, inclusively. Although not by way of limitation, each of first and second sheets 30 and 50 may be configured as congruent rectangles so that the peripheral edge 62 of composite sheet 60 has a pair of opposed longitudinal side edges 64 and a pair of opposed lateral side edges 66.

As also shown in FIG. 2, pallet separator sheet 10 includes a lip 70 which is connected to a portion of peripheral edge 62 and extends the peripheral edge 62. More specifically, this lip 70 extends away downwardly and outwardly at an obtuse angle "a" relative to first sheet 30. While this angle of inclination "a" may be selected as desired, it is preferred that this angle "a" is between 105° and 135°, inclusively. Although FIG. 2 only shows a single lip disposed alongside one of the lateral side edges 66 of composite sheet 60, it should be readily understood that a second lip may also be formed at the opposite end of the composite sheet 60 by creasing the sheet 60 along bend line 72. In any event, lip 70 is included to facilitate gripping and manipulation of the pallet separator sheet 10 and the selected angle has been found to conveniently allow such gripping.

Figure 3:
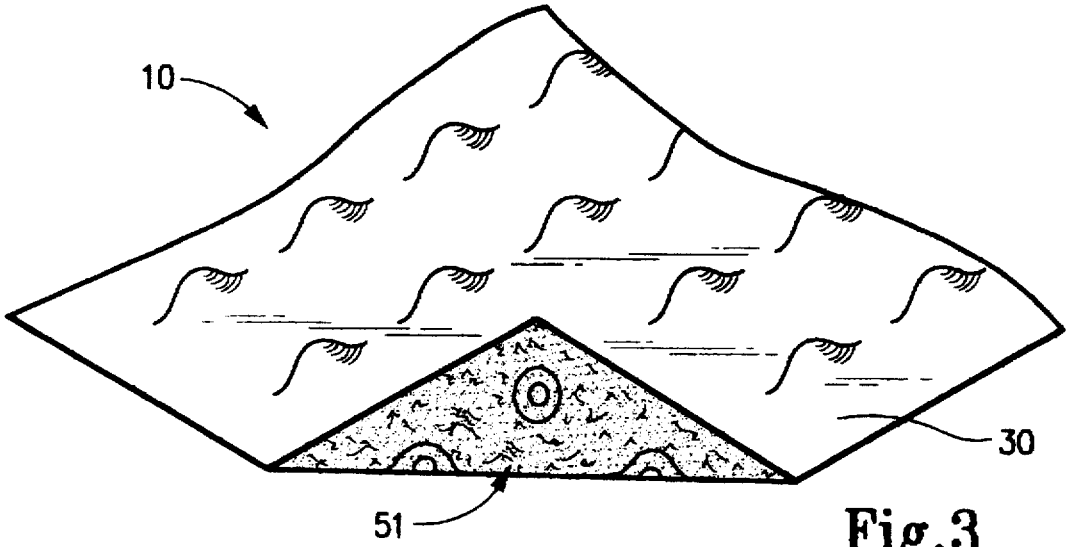
FIG. 3 is an enlarged perspective view of a corner region of a pallet separator, with a portion of the sheet folded back to reveal an alternative construction for the layer of second material on the sheet's lower surface.

The layer of second material 50 may be formed as a low density polyethylene in order to achieve a greater coefficient of friction than the first sheet 30 which is fabricated from a high density polyethylene material. Of course, it should be readily appreciated by the ordinarily skill artisan in this field that a desirable coefficient of friction for the layer of second material 50 may also be achieved by placing a layer of tacky substance, such as an adhesive 51 or its equivalent, on the lower first sheet surface 34 as shown the second exemplary embodiment depicted in FIG. 3. Accordingly, whether the layer of second material 50 is constructed as a second sheet laminated to first sheet 30 or as a layer of adhesive, it is important that the layer of second material 50 have a sufficient coefficient of friction to allow it to grip cargo 16 without damage thereto.

Figure 4:
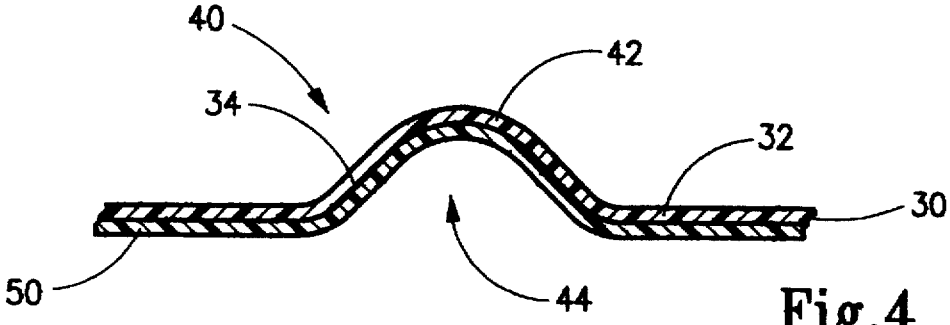
FIG. 4 is an enlarged cross-sectional view of a representative one of the nub structures illustrated in FIG. 2.

FIG. 4 shows a representative construction for one of the nub structures 40 according to the present invention. While representative nub structure 40 is preferably dome-shaped in cross-section, it should be readily appreciated that several alternative shapes may also be incorporated. Thus, by way of example only, each of the nub structures 40 could be in the shape of a cone, a fustrum, an elongated rib or other hollow geometric protrusion It may be seen that representative nub structure 40 is disposed on first sheet 30 so that a protrusion 42 extends upwardly from upper first sheet surface 32. A concavity 44 is thereby formed into the lower composite sheet surface which corresponds to protrusion 42. Protrusion 42 in FIG. 4 is shown to be formed by both the first sheet of material 30 and the layer of second material 50 because these two are laminated together. Accordingly, nub structure 40 may be formed by a conventional stamping process once sheets 30 and 50 are laminated so that the layer of second material 50 extends into and covers portions of the roller first sheet surface 34 located in concavity 44. Of course, it should be understood that the layer of second material 50 need not extend into concavity 44 because the first sheet of material 30 could be stamped prior to the laminating process.

Figure 5:
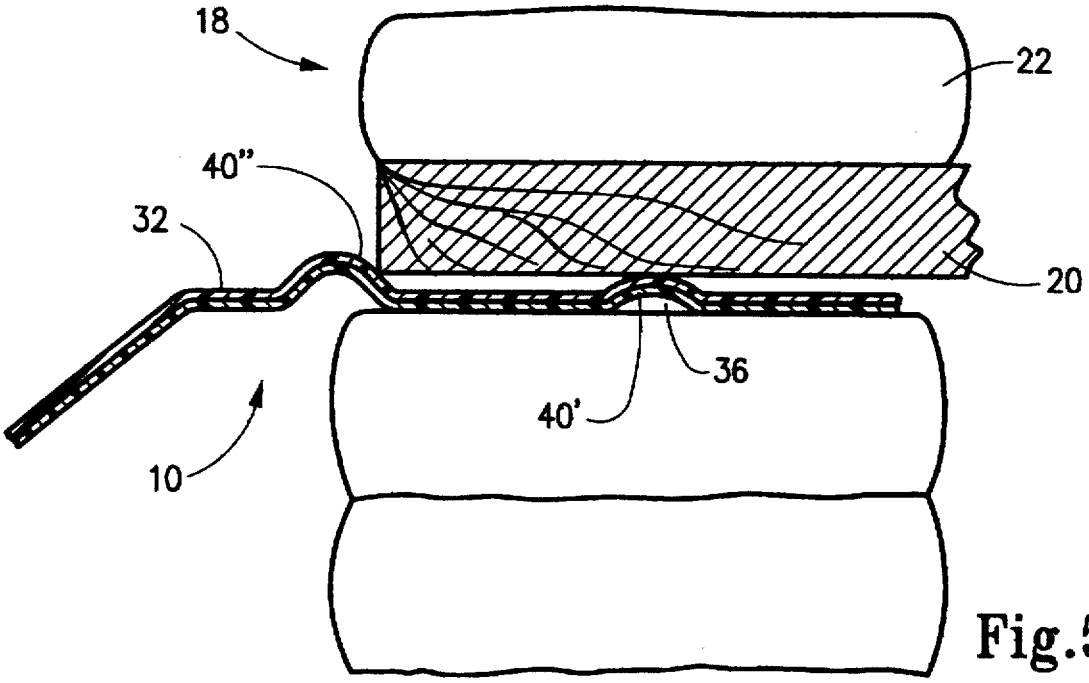
FIG. 5 is an enlarged side view, partially broken away and in partial cross-section, showing the pallet separator sheet of the present invention interposed between a pallet associated with an upper tier of palletized cargo and the cargo associated with a lower tier of palletized cargo.

FIG. 5 illustrates how the nub structures 40 operate when a load is placed on pallet separator sheet 10. Accordingly, when the upper tier of palletized cargo 18 is placed on pallet separator sheet 10, the upper first surface 32 is contacted by upper pallet 20. A contacted nub 40' is collapsed by the upper tier of palletized cargo 18, and specifically pallet 20, to form a collapsed region 36. At the same time, an uncontacted nub 40" forms a raised barrier on the upper first sheet surface 32 which resists sliding movement of pallet 20 and its load thereacross.

A skilled artisan would appreciate the numerous advantages and features of the pallet separator sheet of the present invention which make it superior to existing devices. For example, when interposed between the multiple tiers of palletized cargo, the pallet separator sheet reduces the risk of damage to the lower tier's cargo by providing a protective covering for this cargo. As often encountered in the shipping industry, the shipping pallets may have very coarse regions which can cause damage to cargo. Wooden pallets, in particular, are quite susceptible to splintering which can puncture cargo during storage or transportation The pallet separator sheet of the present invention reduces the risk of potential damage by providing a stiff yet pliable material to protect the underlying cargo.

By incorporating a plurality of collapsible nub structures into the pallet separator sheet, lateral sliding movement of the cargo loaded thereon is inhibited. Therefore, the pallet separator sheet not only conforms to encountered load surfaces, but it keeps loads from shifting during transportation and storage of multiple tiers of palletized cargo. While the collapsible nub structures are particularly suited to prevent load shifting and slippage, the incorporation of an anti-slip layer of material disposed on the lower surface of the pallet separator sheet helps to reduce slippage of the lower tier's cargo thereacross. Other features of the pallet separator sheet described herein is that it protects freight by forming a moisture and dust barrier and can either be discarded after repeated uses or recycled.

Based on the foregoing description of the exemplary embodiment of the pallet separator sheet according to the present invention, it may be appreciated that a methodology is also provided for protecting stacked palletized cargo against lateral slippage during shipment. This methodology is adapted for use with units of cargo which each include a pallet and a selected cargo supported by the pallet. In its broadest form, a first unit of the cargo is initially placed at a selected location. This first unit of cargo is then covered with a separator sheet that has a lower surface and an opposite upper surface with this separator sheet being formed of at least two materials which have different coefficients of friction, with the lower surface having a higher coefficient of friction than the upper surface. Next, a second unit of cargo is placed on top of the first unit of cargo such that the separator sheet is interposed between the first and second units. With this orientation, the second unit has a second pallet contacting the upper surface of the separator sheet so that the second unit is supported by the cargo associated with the first unit. These steps may be repeated for a desired number of vertically stacked cargo units.

In practicing the methodology of the present invention, it is preferred that the separator sheet have either a lip extending outwardly and downwardly from a portion of its peripheral edge or a plurality of nub structures formed into the sheet so that a plurality of protrusions extend upwardly from the upper surface. Both of these features may also be incorporated into a singe separator sheet. It is also preferred that the upper surface of the separator sheet is formed by a first sheet constructed of a stiff yet pliable material, such as high density polyethylene, and that a lower surface of the separator sheet is formed by a second sheet constructed of a low density polyethylene material. The first and second sheets can be laminated together to provide a one-piece unitary construction.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A pallet separator sheet adapted to be placed between multiple tiers of palletized cargo that each includes a pallet upon which cargo is supported, said pallet separator sheet for allowing storage and transportation of said tiers with a reduced risk of damage to the cargo, comprising:

(a) a first sheet constructed of a stiff yet pliable first material and having a first sheet surface which is adapted to be placed in contact with the pallet associated with a first one of said tiers of palletized cargo and an opposite second sheet surface which is adapted to be placed in a facing relationship with the cargo associated with a second one of said tiers of palletized cargo;

(b) a plurality of nub structures disposed on said first sheet thereby forming a plurality of protrusions which extend away from said first sheet surface;

(c) a plurality of concavities formed into said second sheet surface to correspond with said plurality of protrusions so that when said first sheet is placed between said tiers of palletized cargo, contacted ones of said nub structures are operative to collapse while uncontacted ones of said nub structures form a raised barrier on said first sheet surface which resists sliding movement of the pallet thereacross; and (d) a layer of second material disposed on said second sheet surface, said second material having a greater coefficient of friction than said first material thereby to allow said second sheet surface to grip cargo associated with the second one of said tiers of palletized cargo when said pallet separator sheet is interposed between said tiers.

2. A pallet separator sheet according to claim 1 wherein said layer of second material is constructed as a second sheet which is laminated to said first sheet of material to form a composite sheet having a first composite sheet surface which is defined by the first surface of said first sheet and a second composite sheet surface which is defined by said second sheet, said composite sheet having a surrounding peripheral edge and a thickness between said first and second composite sheet surfaces.

3. A pallet separator sheet according to claim 2 wherein the thickness of said composite sheet is between 0.015 inches and 0.08 inches, inclusively.

4. A pallet separator sheet according to claim 2 wherein said first and second sheets are geometrically congruent.

5. A pallet separator sheet according to claim 4 including a lip extending away and outwardly from a portion of the peripheral edge of said composite sheet.

6. A pallet separator sheet according to claim 5 wherein each of said first and second sheets is configured as a rectangle so that the peripheral edge of said composite sheet has a pair of opposed longitudinal side edges and a pair of opposed lateral side edges, said lip extending away and outwardly from said opposed lateral side edges.

7. A pallet separator sheet according to claim 5 wherein said lip is constructed of a layer of stiff yet pliable material.

8. A pallet separator sheet according to claim 1 wherein said stiff first material is a high density polyethylene.

9. A pallet separator sheet according to claim 1 wherein said second material is a low density polyethylene.

10. A pallet separator sheet according to claim 1 including a lip extending away and outwardly from a portion of a periphery of said first sheet of material.

11. A pallet separator sheet according to claim 1 wherein said second material extends into and covers portions of the second sheet surface of said first sheet which are located in said concavities.

12. A pallet separator sheet adapted to be placed between multiple tiers of palletized cargo that each includes a pallet upon which cargo is supported, said pallet separator sheet for allowing storage and transportation of said tiers with a reduced risk of damage to the cargo, comprising:

(a) a first sheet constructed of a stiff yet pliable first material and having a first sheet surface which is adapted to be placed in contact with the pallet associated with a first one of said tiers of palletized cargo and an opposite second sheet surface which is adapted to be placed in a facing relationship with the cargo associated with a second one of said tiers of palletized cargo, said first sheet of material having an outer periphery;

(b) a plurality of nub structures disposed on said first sheet thereby forming a plurality of protrusions which extend away from said first sheet surface;

(c) a plurality of concavities formed into said second sheet surface to correspond with said plurality of protrusions so that when said first sheet is placed between said tiers of palletized cargo, contacted ones of said nub structures are operative to collapse while uncontacted ones of said nub structures form a raised barrier on said first sheet surface which resists sliding movement of the pallet thereacross;

(d) a lip connected to a portion of said outer periphery and extending away at an obtuse angle relative to said first sheet of material; and (e) a layer of second material disposed on said second sheet surface, said second material having a greater coefficient of friction than said first material to allow said second sheet surface to grip cargo associated with the second one of said tiers of palletized cargo when said pallet separator sheet is interposed between said tiers.

13. A pallet separator sheet according to claim 12 wherein said second material is a low density polyethylene.

14. A pallet separator sheet according to claim 12 wherein said first material is high density polyethylene.

15. A pallet separator sheet according to claim 12 wherein said angle is between 105° and 135°, inclusively.

16. A pallet separator sheet according to claim 12 wherein said first sheet of material is configured as a rectangle so that said outer periphery has a pair of opposed longitudinal side edges and a pair of opposed lateral side edges, said lip extending away from a majority of said outer periphery.

17. A pallet separator sheet according to claim 12 wherein said second material is constructed as a second sheet which is laminated to said first sheet of material to form a composite sheet having a first composite sheet surface which is defined by the first surface of said first sheet and a second composite sheet surface which is defined by said second sheet, and composite sheet having a thickness between said first and second composite sheet surfaces.

18. A pallet separator sheet according to claim 17 wherein said first and second sheets are geometrically congruent.

19. A pallet separator sheet according to claim 17 wherein the thickness of said composite sheet is between 0.015 inches and 0.08 inches, inclusively.

* * * * *